United States Patent [19]

Knapton et al.

[11] Patent Number: 4,803,476

[45] Date of Patent: Feb. 7, 1989

[54] VIDEO TERMINAL FOR USE IN GRAPHICS AND ALPHANUMERIC APPLICATIONS

[75] Inventors: Edward Knapton, Milford; Ernest Vincent, Windham, both of N.H.

[73] Assignee: Visual Technology Incorporated, Lowell, Mass.

[21] Appl. No.: 922,669

[22] Filed: Oct. 24, 1986

[51] Int. Cl.[4] ..... G09G 1/16

[52] U.S. Cl. ..... 340/750; 340/814; 340/748; 330/51

[58] Field of Search ..... 340/723, 735, 750, 748, 340/703, 814, 799, 813; 330/51; 307/356, 362; 315/411; 358/150, 140, 190

[56] References Cited

U.S. PATENT DOCUMENTS

| | | | |
|---|---|---|---|
| Re. 31,200 | 4/1983 | Sukonick et al. | 340/799 |
| 3,818,128 | 6/1974 | Chambers et al. . | |
| 4,063,221 | 12/1977 | Watson et al. . | |
| 4,176,304 | 11/1979 | Scott | 315/411 |
| 4,307,421 | 12/1981 | Smit . | |
| 4,386,367 | 5/1983 | Peterson et al. . | |
| 4,482,919 | 11/1984 | Alston et al. . | |
| 4,527,250 | 7/1985 | Galdun et al. . | |
| 4,539,592 | 9/1985 | Tanaka et al. . | |
| 4,598,236 | 7/1986 | Hepworth . | |
| 4,608,602 | 8/1986 | Grantham-Hill . | |
| 4,616,260 | 10/1986 | Erwin et al. | 358/150 |
| 4,646,077 | 2/1987 | Culley | 340/748 |
| 4,703,322 | 10/1987 | Goss et al. | 340/750 |

FOREIGN PATENT DOCUMENTS 7221127 5/1983 China .

OTHER PUBLICATIONS

Texas Instruments, "Line Circuits and Display Drivers", vol. 2 of Linear and Interface Circuits Applications, pp. 9–5, 9–16, 9–36 and 9–40.

*Primary Examiner*—John W. Caldwell, Sr.
*Assistant Examiner*—Alvin Oberley
*Attorney, Agent, or Firm*—Burns, Doane, Swecker and Mathis

[57] ABSTRACT

A bit-mapped graphics terminal capable of displaying graphs as well as text permits character and screen attributes to be controlled with minimal memory requirements, and is capable of operating as an interlaced display and as a non-interlaced display. A first memory stores a display bit map that defines characteristics of individual picture elements of the display. A second memory stores attribute information for individual groups of the picture elements of the display.

6 Claims, 10 Drawing Sheets

80 COLUMN MODE

| ROW BUFFER FETCH | DISPLAYED DATA chr. 0 | chr. 1 | chr. 2 | chr. 3 | | chr. 78 | chr. 79 |
|---|---|---|---|---|---|---|---|
| (R B)---→A | A | A+32 | A+64 | A+96 | | | |
| | A+2 | | | | | | |
| | A+4 | | | | | | |
| | A+6 | | | | | | |
| | A+8 | | | | | | |
| | A+10 | | | | | | |
| | A+12 | | | | | | |
| | A+14 | | | | | | |
| | A+16 | | | | | | |
| | A+18 | | | | | | |
| | A+20 | | | | | | |
| | A+22 | | | | | | |
| | A+24 | | | | | | |
| | A+26 | | | | | | |
| | A+28 | | | | | | |
| | A+30 | | | | | | |
| (RB)---→B | B | B+32 | B+64 | | | | |
| | B+2 | B+34 | | | | | |
| | B+4 | | | | | | |

132 / GRAPHICS MODE

| ROW BUFFER FETCH | DISPLAYED DATA chr. 0 | chr. 1 | chr. 2 | chr. 3 | chr. 4 | | chr. 130 | chr. 131 |
|---|---|---|---|---|---|---|---|---|
| (R B)---→A | A | A+1 | A+32 | A+33 | A+64 | | | |
| | A+2 | A+3 | A+34 | | | | | |
| | A+4 | A+5 | | | | | | |
| | A+6 | | | | | | | |
| | A+8 | | | | | | | |
| | A+10 | | | | | | | |
| | A+11 | | | | | | | |
| | A+14 | | | | | | | |
| | A+16 | | | | | | | |
| | A+18 | | | | | | | |
| | A+20 | | | | | | | |
| | A+22 | | | | | | | |
| | A+24 | | | | | | | |
| | A+26 | | | | | | | |
| | A+28 | | | | | | | |
| | A+30 | | | | | | | |
| (R B)---→B | B | B+1 | B+32 | | | | | |
| | B+2 | B+3 | | | | | | |
| | B+4 | | | | | | | |

80 COLUMN MODE

| | chr. 0 | chr. 1 | chr. 2 | chr. 3 | chr. 4 | chr. 5 | chr. 6 | chr. 7 | chr. 8 | |
|---|---|---|---|---|---|---|---|---|---|---|
| ADDRESS OF CHAR. | 800000 | 800020 | 800040 | 800060 | 800080 | 8000A0 | 8000C0 | 8000ED | 800100 | |
| ADDRESS OF ATTRIBUTE | C00021 | C00021 | C00061 | C00061 | C000A1 | C000A1 | C000E1 | C000E1 | B00121 | |
| | | | | | | | | | | |

132 / GRAPHICS MODE

| | chr. 0 | chr. 1 | chr. 2 | chr. 3 | chr. 4 | chr. 5 | chr. 6 | chr. 7 | chr. 8 | |
|---|---|---|---|---|---|---|---|---|---|---|
| ADDRESS OF CHAR | 800000 | 800001 | 800020 | 800021 | 800040 | 800041 | 800060 | 800061 | 800080 | |
| ADDRESS OF ATTRIBUTE | C00001 | C00001 | C00021 | C00021 | C00041 | C00041 | C00061 | C00061 | C00081 | |
| | | | | | | | | | | |

ATTRIBUTES FOR EVEN CHARACTES (chr. 0, chr. 2------) ARE IN THE UPPER 4 BITS OF EACH BYTE ATTRIBUTES FOR ODD CHARACTERS (chr. 1, chr. 3-----) ARE IN THE LOWER 4 BITS OF EACH BYTE

VIDEO TERMINAL FOR USE IN GRAPHICS AND ALPHANUMERIC APPLICATIONS

CROSS-REFERENCE TO RELATED PATENT APPLICATIONS

This application is related to a co-pending application Ser. No. 923,123, filed Oct. 23, 1986, by Gerard A. Desilets, Jr., and entitled "A Versatile Computer Terminal". The specification of the foregoing related application is hereby incorporated by reference.

BACKGROUND OF THE INVENTION

The present invention relates to a computer terminal which combines features of graphics terminals with those of alphanumeric terminals. More particularly, the present invention relates to a bit-mapped computer terminal capable of operating in a graphics mode or in an alphanumeric mode.

Modern display terminals are packaged and sold as sophisticated equipment that is far more complex than a simple cathode ray tube (CRT) display unit. These terminals are frequently sold together with a keyboard, a data link for receiving data from a computer, and microprocessors for carrying out the functions of driving the CRT, monitoring the keyboard, and controlling communications through the data link. The microprocessors also control certain features such as scrolling and cursor controls and other controls that facilitate use of the terminal. These microprocessors also allow the terminal to perform limited data processing or word processing functions, and include special modules containing read-only memories. These modules may be in the form of ROMs, PROMs, EPROMs, or other suitable memory, and may be used to store the software instructions for_ operating the microprocessor. Displayed character fonts and the like may be determined by the information stored in the read-only memory.

The sophistication of modern alphanumeric terminals provides greater control over displayed information. For example, various character attributes, such as whether a particular character or group of characters blinks, is displayed in reverse-video (i.e. black character on a white background), or is highlighted, can be stored in terminal memory. This added flexibility enhances the display and permits tailoring of the display to the particular desires of the user.

A typical display device provides a plurality of horizontal scans per screen. For example, a single display screen might include approximately 400 horizontal scans per screen. The horizontal scanning frequency may be approximately 32 KHz and the vertical scanning frequency, i.e. the frequency at which the entire display is updated may be approximately 60 Hz. A vertical scanning frequency of 60 Hz permits the terminal to synchronize the vertical retrace with the standard AC line frequency. Of course, when a terminal is marketed throughout the world, the standard AC line frequency may vary from place to place. An AC line frequency different than 60 Hz, however, will seriously affect the operation of a terminal intended for use with a 60 Hz power supply.

Terminals may operate as either an interlaced display or a non-interlaced display. A non-interlaced display updates the entire display during each vertical trace. In other words, each of the raster lines is updated for each vertical trace. An interlaced display, on the other hand, only updates every other raster line during each vertical trace. For example, raster lines 1, 3, 5 . . . , 399 would be updated during a first vertical trace and raster lines 2, 4, 6 . . . , 400 would be updated during a second vertical trace. Raster lines 1, 3, 5 . . . , 399 would again be updated in a third vertical trace.

An interlaced display can be used to increase the vertical resolution of a display. During a first vertical trace, each of the 400 raster lines could be updated. A second vertical trace could then be vertically offset so that the first raster line of the second vertical trace falls between the first and second raster lines of the first vertical trace. In this way, the resolution of a 400 scans per screen display can be increased to 800 scans per screen. Of course, the amount of time required to fully update a screen is doubled.

U.S. Pat. No. 4,482,919 to Alston et al discloses an apparatus for providing a multilaced raster scan system wherein interlacing is provided by selectively varying a DC bias signal which controls the position of the raster lines on the display. Referring to FIG. 5 of the Alston et al patent, a typical interlaced display is illustrated wherein the raster lines of a second field are vertically offset from the raster lines of a first field. Other patents which relate to interlaced displays include U.S. Pat. No. 4,307,421 to Smit, U.S. Pat. No. 4,598,236 to Hepworth, and U.S. Pat. No. 4,608,602 to Grantham-Hill. Hill.

Terminals also may use a bit-map scheme to provide graphics capability. In a standard bit-mapped monochrome terminal the pixels (picture elements) on a display monitor are in one-to-one correspondence with bit locations in a memory. For example, if the bit location corresponding to a particular pixel contains a logic "1", then the pixel will be lighted. If the memory bit location contains a logic "0", then the pixel remains dark. If a terminal has 1056 pixels per raster line and 400 raster lines per screen, then the bit-map memory will require at least 53 Kbytes of memory. Due to additional information required for bit-mapped color terminals, these terminals require several bits for each pixel in the display. Of course, if the memory is not used with the utmost efficiency, the memory requirements of a bit-mapped terminal will increase.

Bit-mapped terminals require a large amount of memory relative to a standard alphanumeric display terminal. In order to provide the character attribute flexibility of an alphanumeric terminal in a bit-mapped system, an exorbitant amount of memory would be required. Each pixel of the display would require an additional bit in memory for each character attribute. Thus, in a bit-mapped terminal which would normally require 64 Kbytes of memory, an additional 256 Kbytes of memory would be required to permit the selection of four bit-mapped character attributes.

In everyday use, it would be convenient to have a terminal which is capable of easily operating as a graphics terminal and as a standard alphanumeric terminal. For example, an application program might use graphics to guide the user in running the application software. Figures could be used to represent the operation of the program. Once the operation of the program has been illustrated, the terminal would be used as a standard alphanumeric terminal. Preferably the terminal would operate as a high-resolution interlaced display when acting as a graphics terminal. In normal use as an alphanumeric terminal, it would often be unnecessary to provide a high-resolution display. Of course, it is desirable to maintain the costs of such a terminal as low as possible.

SUMMARY OF THE INVENTION

The present invention relates to a bit-mapped computer terminal including a display having a plurality of individual picture elements. A first memory is provided for storing a display bit map wherein each picture element of the display corresponds to one bit in the first memory. A second memory is provided for storing attribute information for individual groups of picture elements. A video control circuit selectively lights individual picture elements of the display in response to the bit map stored in the first memory and the attribute information stored in the second memory.

In another aspect of the invention, scanning of the display monitor may take place in an interlaced or in a non-interlaced mode. Selection of the interlaced or non-interlaced mode may be made by an input from a keyboard or by an input from a remote system. Preferably, the mode selection input from the remote system is a private coding sequence. By operating the display at a refresh rate of 70 Hz rather than 60 Hz, flicker in the display is reduced.

A switched power supply is provided for operating the computer terminal. The switching frequency of the switched power supply is set to be equal to the horizontal scan frequency. Increased power demand is met by widening the pulses from the switched power supply. The design of the terminal is greatly simplified and processing time is reduced by representing a single character with contiguous memory locations in the bit map memory. Additionally, an interface is provided to allow the terminal to receive either dual differential data transmission or single-ended data transmission.

BRIEF DESCRIPTION OF THE DRAWINGS

The objects, features and advantages of the present invention will become apparent from the following detailed description when read in conjunction with the accompanying drawings, in which.

DETAILED DESCRIPTION OF THE PREFERRED EMBODIMENT

The present invention is described below in connection with a bit-mapped monochrome computer terminal. Of course, the following description is merely illustrative of the features of the present invention. The features of the present invention may likewise be incorporated, for example, into a color terminal.

Figure 1:
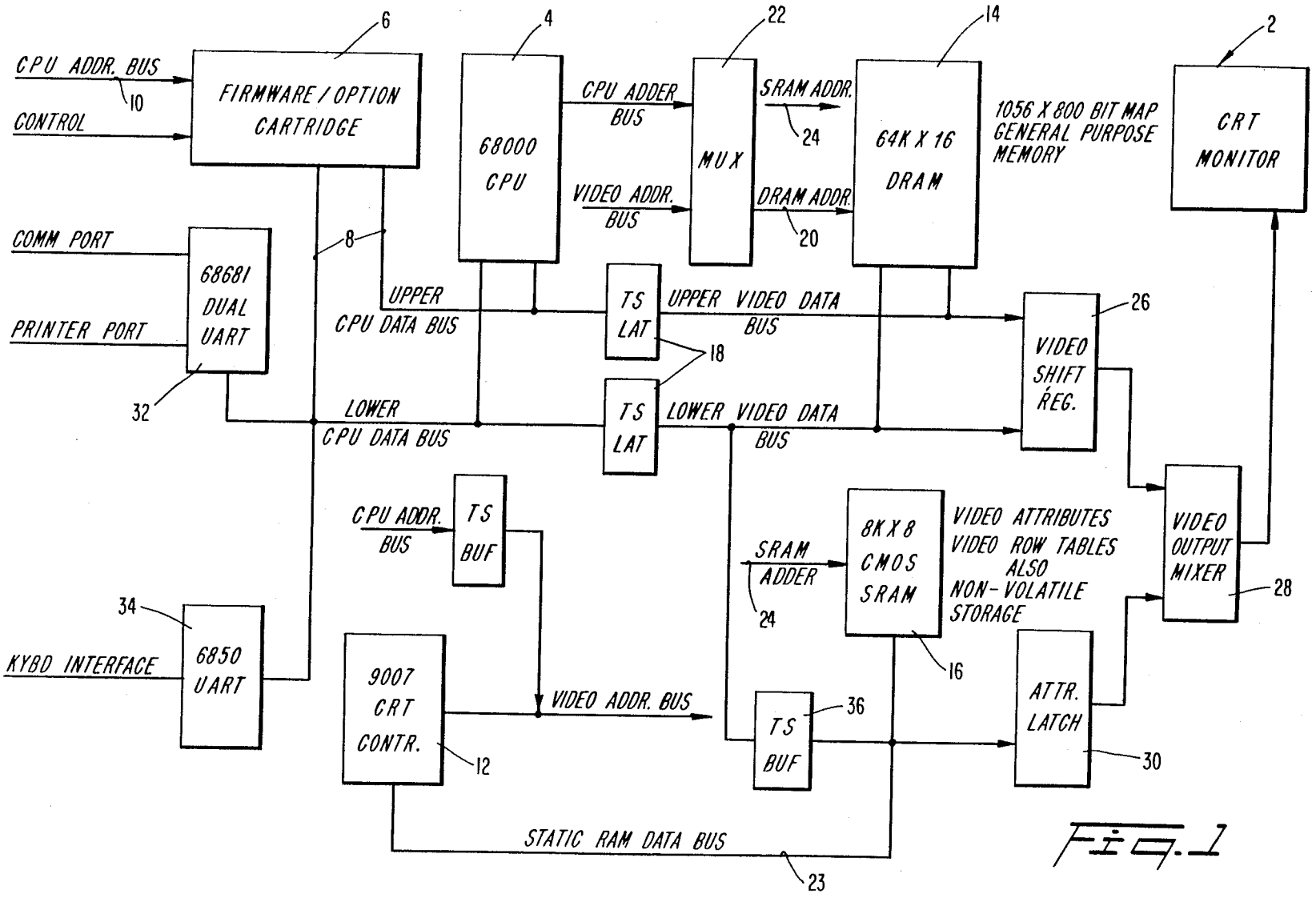
FIG. 1 is a schematic circuit diagram of a computer terminal in accordance with a preferred embodiment of the present invention.

Referring to FIG. 1, the terminal of the present invention includes a video display screen 2 which may display graphical and/or alphanumeric information. The terminal further includes a central processing unit (CPU) 4 which controls the operation of the terminal by executing instructions stored in memory circuits. Preferably, the CPU 4 is a 16-bit high-speed processor such as a Motorola MC68000. It will be understood by those skilled in the art that any suitable processor, including 8-bit processors and 32-bit processors, may be used in the context of the present invention with appropriate changes to the terminal circuitry.

The instructions which are executed by the CPU 4 are preferably stored in read-only memory circuits such as EPROMs or the like. This read-only memory may be located in a personality module 6 for increased terminal versatility. The details of the personality modules 6 are fully described in the aforementioned related patent application. As is well known in the digital processing art, instructions stored in the read-only memory are communicated to the CPU 4 along a data bus 8 from memory locations selected by the CPU 4 through an address bus 10.

The CPU 4 directs the operation of the other components of the terminal so as to form the desired alphanumeric characters or graphic illustration on the CRT display 2. These additional components include a CRT controller circuit 12 and additional memory circuits 14 and 16 which are arranged to provide a bit-mapped output on CRT display 2.

A standard character mapped alphanumeric terminal addresses its screen by maintaining row and column addresses to the characters to be displayed. Similarly, an attribute position is stored in memory. The memories are then overlaid on one another so that the mapped characters appear on the screen with the desired attribute, e.g. as a blinking, blank, reverse-video, reduced, or underlined character.

A bit-mapped terminal provides greater graphics capabilities because it allows any particular pixel on the screen to be lighted at any particular time. Difficulties arise, however, in allocating attributes to a bit-mapped display. Each bit of the bit-map would require an additional bit of memory to store each attribute. By providing the capability of having several possible attributes, the memory required in a bit-mapped terminal is vastly increased. The cost and complexity of such a terminal likewise increases with the additional memory requirements.

In a computer terminal according to the preferred embodiment of the present invention, a $1056 \times 800$ bit map for the monitor 2 is effectively created in a memory circuit 14 which may advantageously be comprised of dynamic random access memory (DRAM) integrated circuits. In a bit-mapped terminal the pixels on the display monitor have a one-to-one correspondence with bit locations in a memory. Data is written into the bit-map by the CPU 4 and is then read from the bit map and written onto the CRT 2 by the CRT controller 12. The information written into the bit-map memory 14 is read by the CPU 4 from the read-only memory of personality module 6. To avoid contention for the data bus 8 between the CPU 4 and controller 12, tri-state latches 18 selectively isolate the CPU from the controller thereby allowing the CPU 4 to communicate with the personality module 6 while the controller communicates with the bit-map memory 14. The address lines 20 of the memory 14 are shared by the CPU 4 and controller 12 through the well-known operation of a multiplexer 22.

The CPU 4 and controller 12 may also communicate with an attribute memory 16 which, in one embodiment, may be CMOS static RAM integrated circuits. To enhance the writing speed of the terminal, attributes of the characters to be written onto the display 2 are stored in the attribute memory 16. These attributes include the grouping of bits in the bit ma which compose the alphanumeric character positions on the display, as well as blinking, reverse-video and highlighting of the characters. The contents of the attribute memory 16 are accessed in the usual manner through a SRAM data bus 23 and a SRAM address bus 24 by either the CPU 4 or the CRT controller 12. The CPU 4 can both read and write data to the attribute memory 16. The controller 12 reads from memory 16 during the horizontal blanking intervals to get display pointer addresses, but does not write to the memory 16.

The attribute memory 16 stores attribute information for a particular character location. For example, if individual characters are denoted on the display 2 by a $13\times16$ array of pixels, the attribute information for that array would be stored in attribute memory 16. Thus, in a bit-mapped display, the attributes of a single character affect the display of 13 contiguous pixels in a series of 16 consecutive raster lines. In this way, the attribute information for each pixel in the character array need not be stored separately. Rather, a single bit of memory can be used to represent the entire array. Representing an attribute of each pixel of the array individually would require $13*16=208$ bits of memory. For a display having 80 characters per line and 25 characters per screen this represents a memory savings of approximately 52 Kbytes of memory for each attribute.

The CRT controller 12 is capable of operating in an interlaced or a non-interlaced video mode. By use of private coding, a user can change from interlaced display and non-interlaced video over communications lines. The change may also be implemented by a local function in the terminal through the terminal keyboard and set-up menus. Conversion from non-interlaced to interlaced video effectively doubles the resolution of the display monitor. For example, a non-interlaced video display having 400 scan lines per screen may have 800 scan lines per screen in the interlaced mode. In the preferred embodiment of the present invention, the bit-map memory 14 is sized to accommodate 800 lines of data to permit an interlaced video display resolution of 800 lines per screen.

The conversion from one video display mode to the other is accomplished by reprogramming the CRT controller 12 which is preferably a 9007 CRT controller. Of course, it will be understood that other appropriate CRT controller circuits may also be used. Thus, the CPU 4 is able to control the video display mode of the CRT controller 12. As mentioned above, the change-over of modes may be caused by receipt of a private coding sequence over a data transmission line or locally with the help of a set-up menu.

In interlaced scanning, each horizontal scan is updated only once for every two vertical traces. Accordingly, the phosphor chosen for the CRT screen must have a slow persistence. In other words, the phosphor must remain lit long enough for the CRT to complete two vertical traces. A phosphor with insufficient persistence will lead to a high degree of flicker in the interlaced mode. This flicker is caused by decay of the light generated by the phosphor before a subsequent scan.

A phosphor having a slow persistence, however, may lead to smearing of an image during scrolling, particularly in a non-graphics mode. In the present invention, a medium persistence phosphor such as Clinton Electronics PC188 white phosphor is used. This medium persistence phosphor reduces flicker in the interlaced video mode without causing excessive smearing of the scrolling display. Flicker is also reduced by operating the terminal at a refresh rate of 70 Hz rather than the conventional 60 Hz refresh rate.

Also shown in FIG. 1 are communication interfaces 32 and 34 which control the input and output of digital data from the terminal. The interfaces 32 and 34 may include several universal asynchronous receiver transmitters (UARTs) for providing several serial-data I/O ports to the terminal. It is common to have at least three of these ports, one each for a keyboard, a printer and the host computer. Parallel-data I/O ports may also be provided to the terminal 10. As will be discussed in greater detail below with reference to FIG. 8, circuitry may be provided for enabling receipt of either dual differential data transmission or single-ended data transmission.

Power for the terminal is preferably provided with a switching-type power supply. In order to allow close proximity of the power supply and the CRT monitor 2, thereby enabling a compact design, switching frequency of the power supply is set to be equal to the horizontal scanning frequency of the monitor. With a horizontal sync rate and a power supply switching frequency of 32 KHz avoids interference on the display is avoided by synchronizing the power supply to the monitor.

Since the switching frequency of the power supply is synchronized with the horizontal scanning frequency, increased power demands by the terminal cannot be satisfied by adjusting the switching frequency of the power supply. Accordingly, in the present invention, the width rather than the frequency of the pulses generated by the switching-type power supply is adjusted to accommodate a changed power demand. In other words, an increased power demand by the terminal is met by widening the width of the pulses generated by the switching-type power supply. Conversely, decreased power demand is accompanied by a narrowing of the power supply pulses.

Figure 2A:
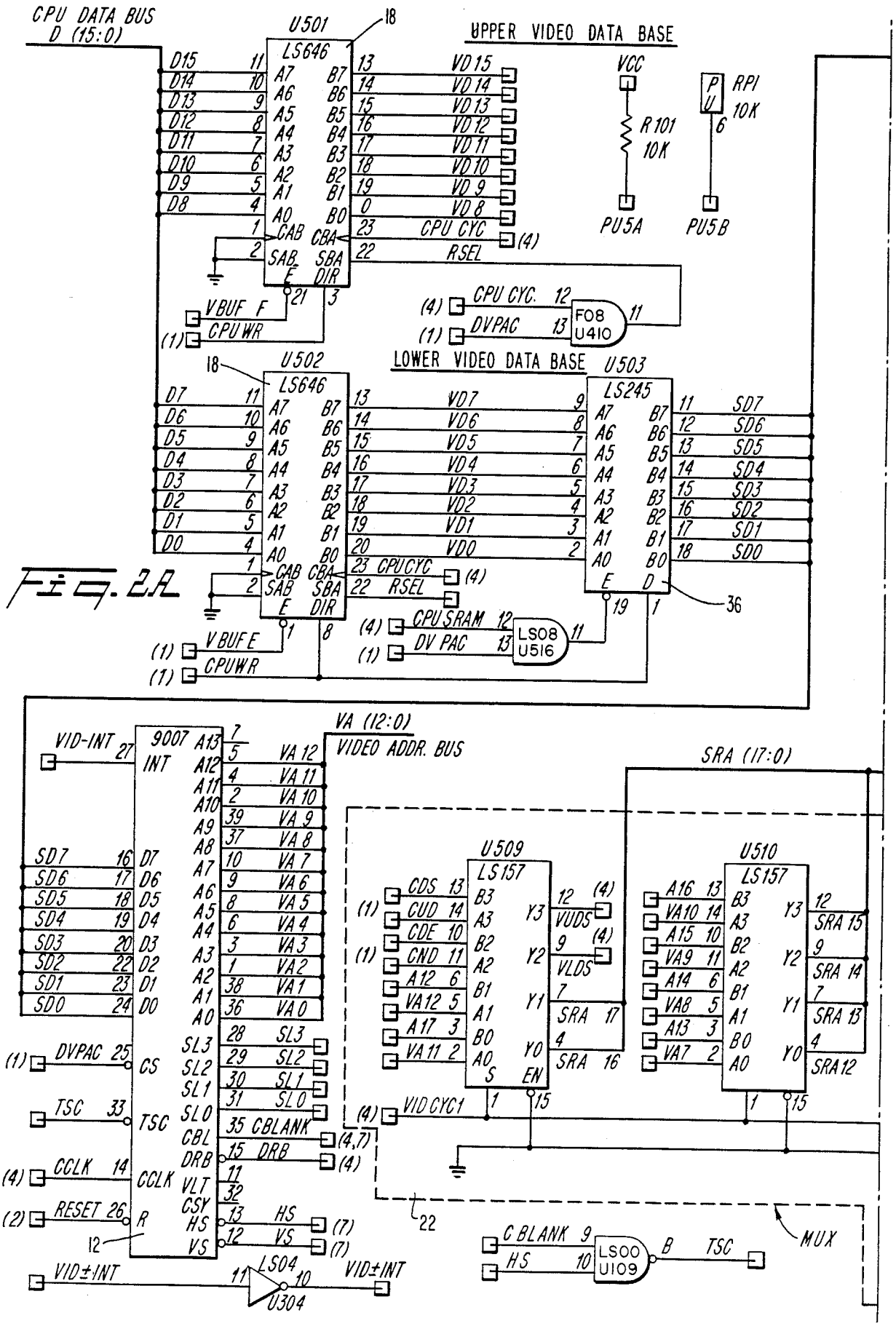
FIG. 2*a* and *b* are is a detailed circuit diagram illustrating the video control circuitry and static RAM in accordance with a preferred embodiment of the invention.
Figure 2B:
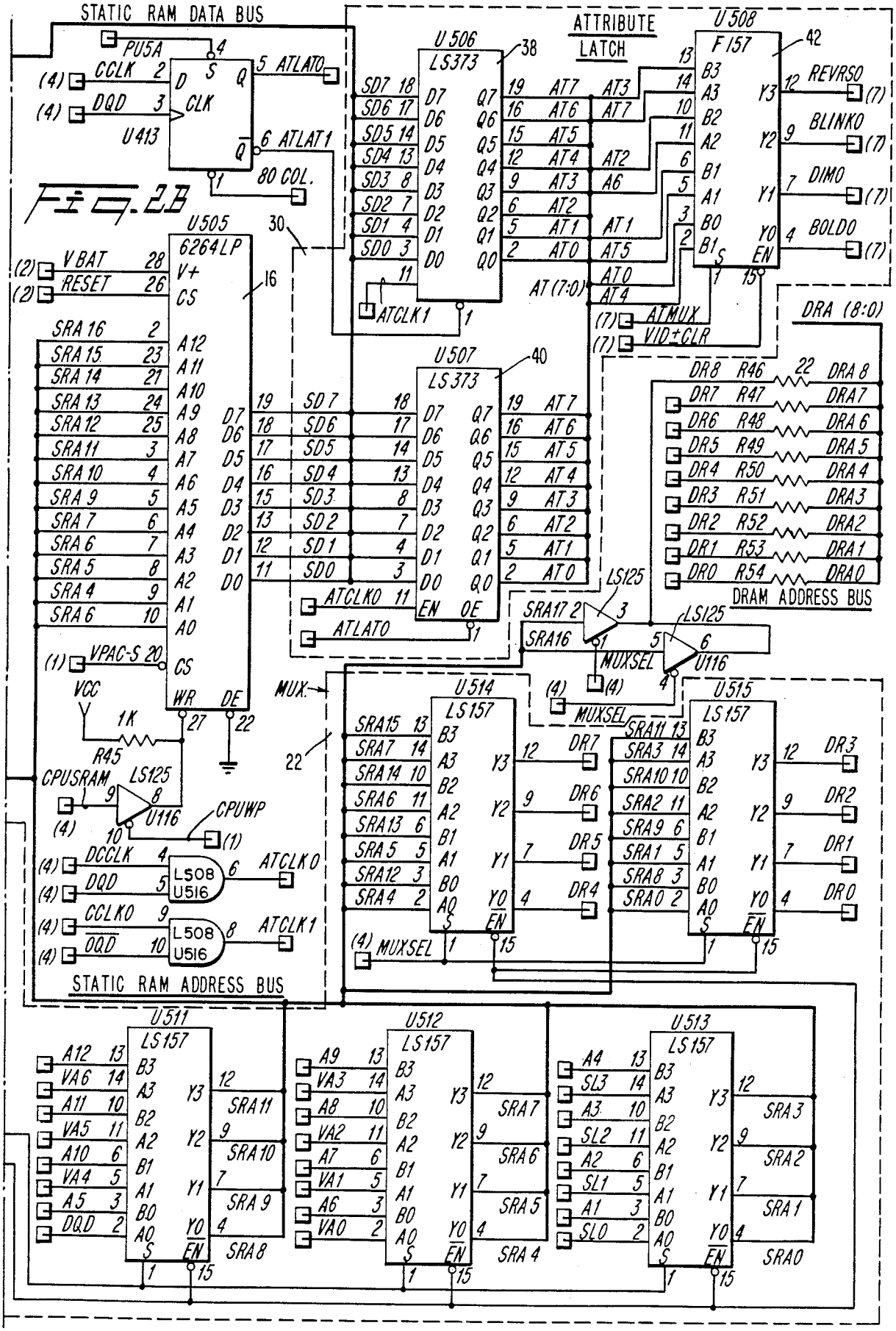

Turning now to FIG. 2, the details of a portion of the video control circuitry and static RAM of the preferred embodiment are disclosed. The video control circuitry includes the 9007 CRT controller 12, latch circuits 18, buffer 36, MUX 22 and attribute latch 30. The attribute memory 16 is illustrated by a static RAM integrated circuit.

As shown, the MUX 22 includes a plurality of one-of-two selection circuits which operate in a conventional manner. Alternative multiplexing arrangements could also be arranged by one skilled in the art. The attribute latch includes a pair of latch circuits 38 and 40 and a one-of-two selection circuit 42. In the case where the attribute memory is used to store information for four attributes, the attribute information for two characters can be stored in a single byte of memory. For example, bits 0 and 4 of a single byte can be used to indicate whether a first character and a second character, respectively, should appear in boldface. Likewise, corresponding bits (1 and 5, 2 and 6, 3 and 7) of the adjacent nibbles (a nibble may be either the four most significant bits or the four least significant bits of a byte) each represent an attribute of first and second characters. The one-of-two selection circuit enables the attribute latch to output the proper bits in accordance with which character is currently being displayed.

Figure 3A:
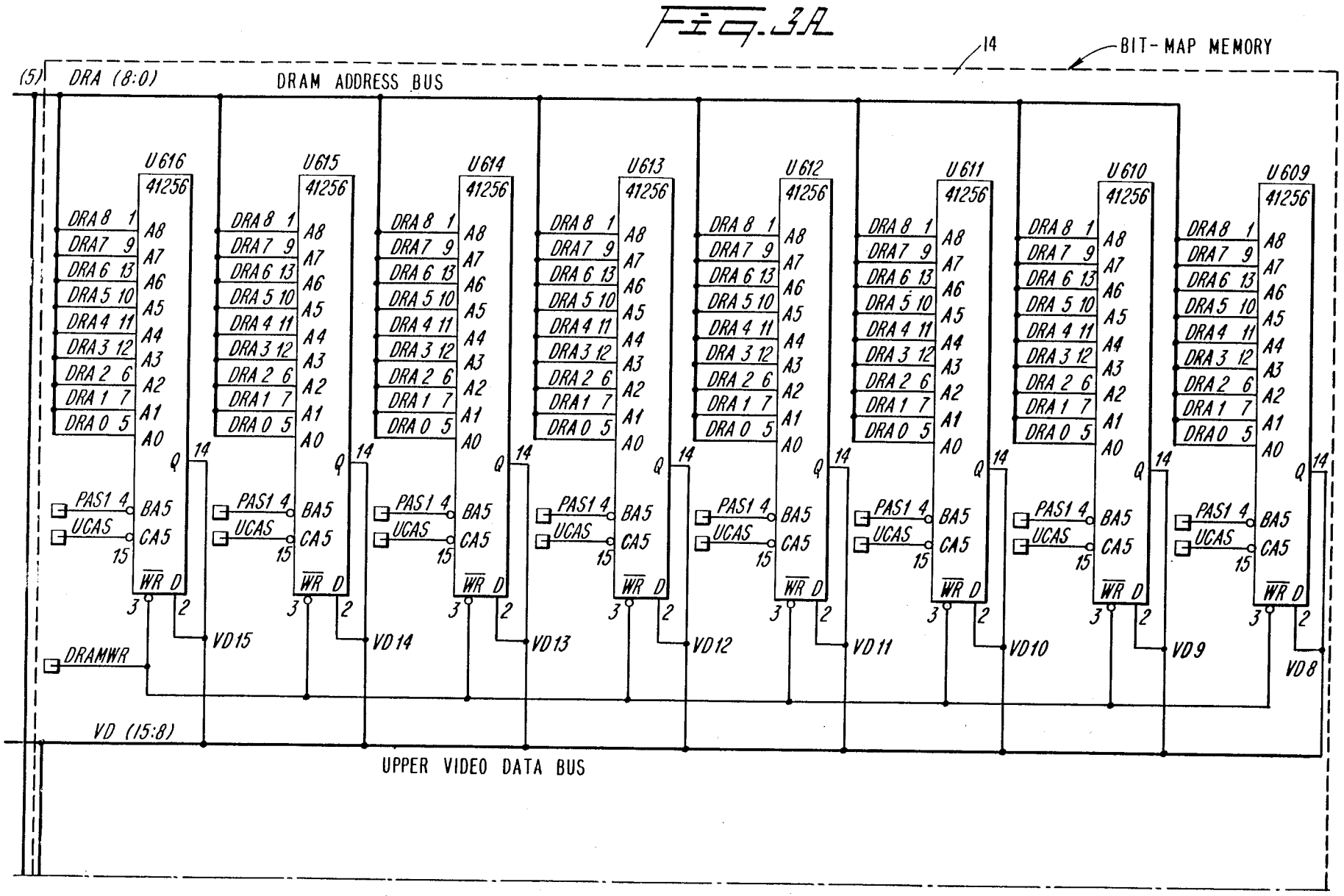
FIG. 3*a* and *b* detailed circuit diagram illustrating a dynamic RAM array for use in the preferred embodiment of the present invention.
Figure 3B:
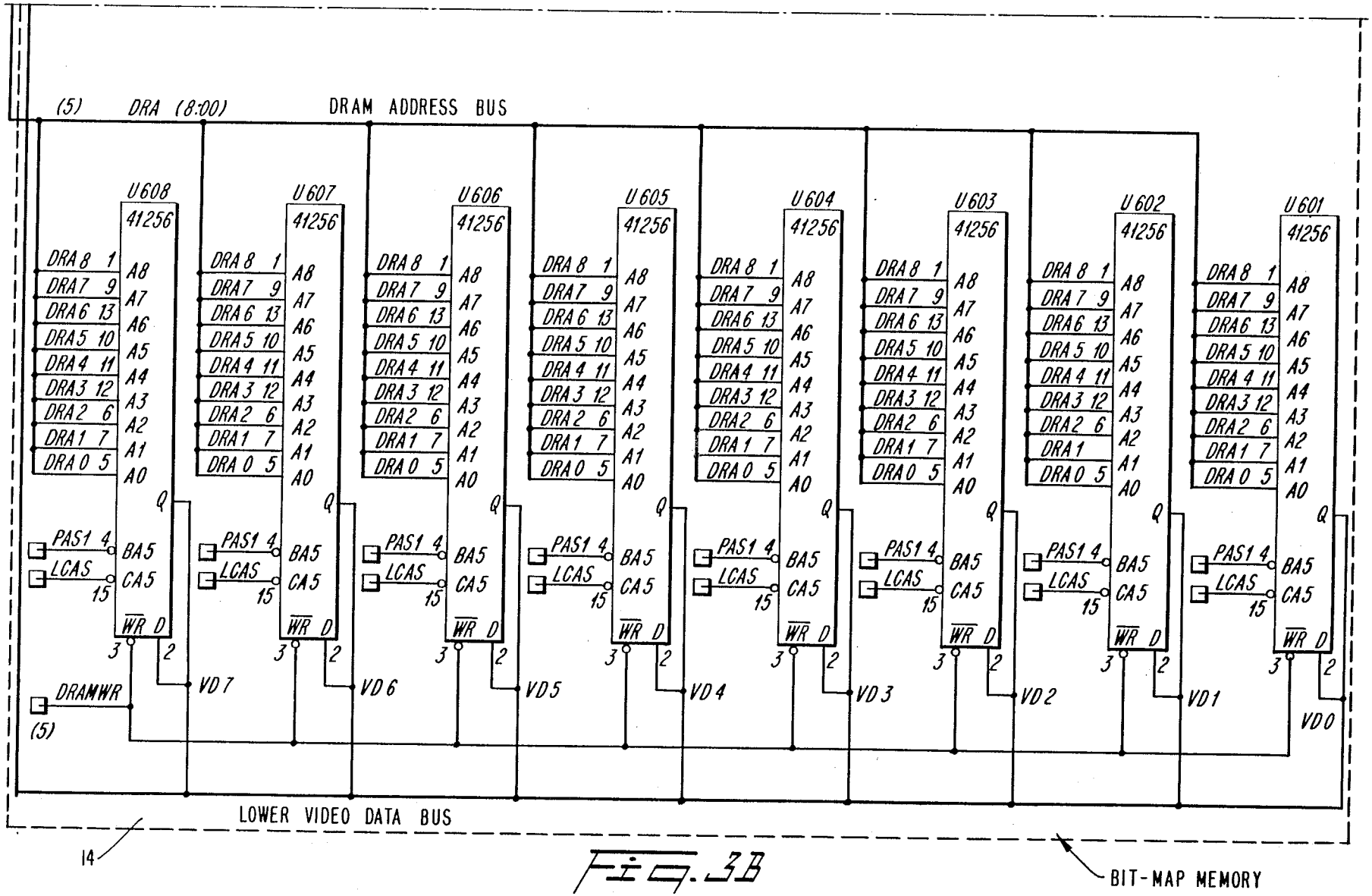

FIG. 3 illustrates the circuitry used to implement bit-map memory 14. As illustrated, the bit-map memory 14 includes an array of sixteen memory circuits 14-0 through 14-15 connected in parallel. Each memory circuit corresponds to a particular line of the 16-bit video data bus. For instance, memory circuit 14-0 is coupled to video data bus line VDO, memory circuit 14-1 is coupled with video data bus line VDI, etc. To implement a 64K×16 bit dynamic RAM, each of the memory circuits 14-0 to 14-15 may be a 64K×1 bit memory circuit. In other words, each memory circuit contains one bit of information for each of 64K memory locations. It will be readily appreciated that alternative memory configurations may also be used.

Figure 4:
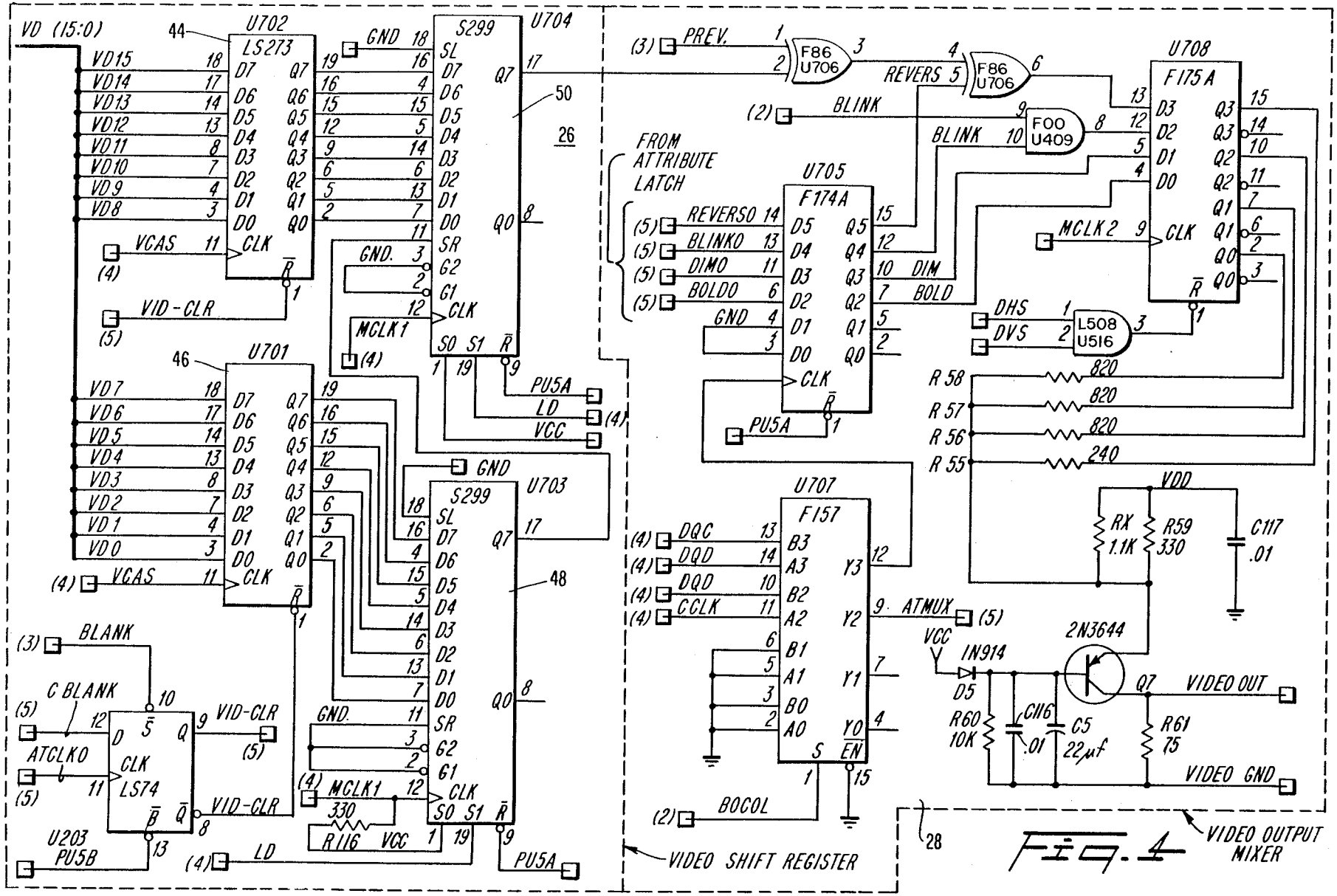
FIG. 4 is a detailed circuit diagram illustrating video output and attribute logic in accordance with a preferred embodiment of the present invention.

FIG. 4 illustrates the particular video shift register circuitry and video mixing circuitry for use in the preferred embodiment of present invention. The video shift register circuit 26 includes a pair of latch circuits 44 and 46 which latch the high order data bits and the low order data bits, respectively, appearing on the video data bus. The low order data bits latched by latch circuit 4 provide parallel inputs to a shift register 48. Likewise, the high order data bits from latch circuit 44 provide parallel inputs to shift register 50. In the particular configuration shown, shift registers 48 and 50 are 8-bit bidirectional shift-storage registers. The shift registers have been cascaded to provide a parallel to serial conversion for the 16-bit data. Alternative circuitry could readily be constructed to perform the same function as the cascaded shift registers 48 and 50.

Shift register 50 outputs a serial stream of data corresponding to the data on the video data bus. This serial stream is input to the video output mixer 28. The video output mixer 28 operates in response to the serial stream and the attribute information from the attribute latch 30 to provide an output signal for a standard CRT monitor.

The present invention may operate to display text in either eighty columns or in one hundred thirty-two columns. In the eighty column mode a normal non-interlaced text display is twenty-five lines of eighty characters, with each character cell being 13×16 pixels. In the interlaced mode the number of lines of eighty characters is increased to fifty. The display can also operate in a non-interlaced mode to provide twenty-five lines of one hundred thirty-two characters, with each character cell being 8×16 pixels. The one hundred thirty-two column display may also be operated in an interlaced mode, in which case fifty lines of characters would be displayed.

Figure 5A:
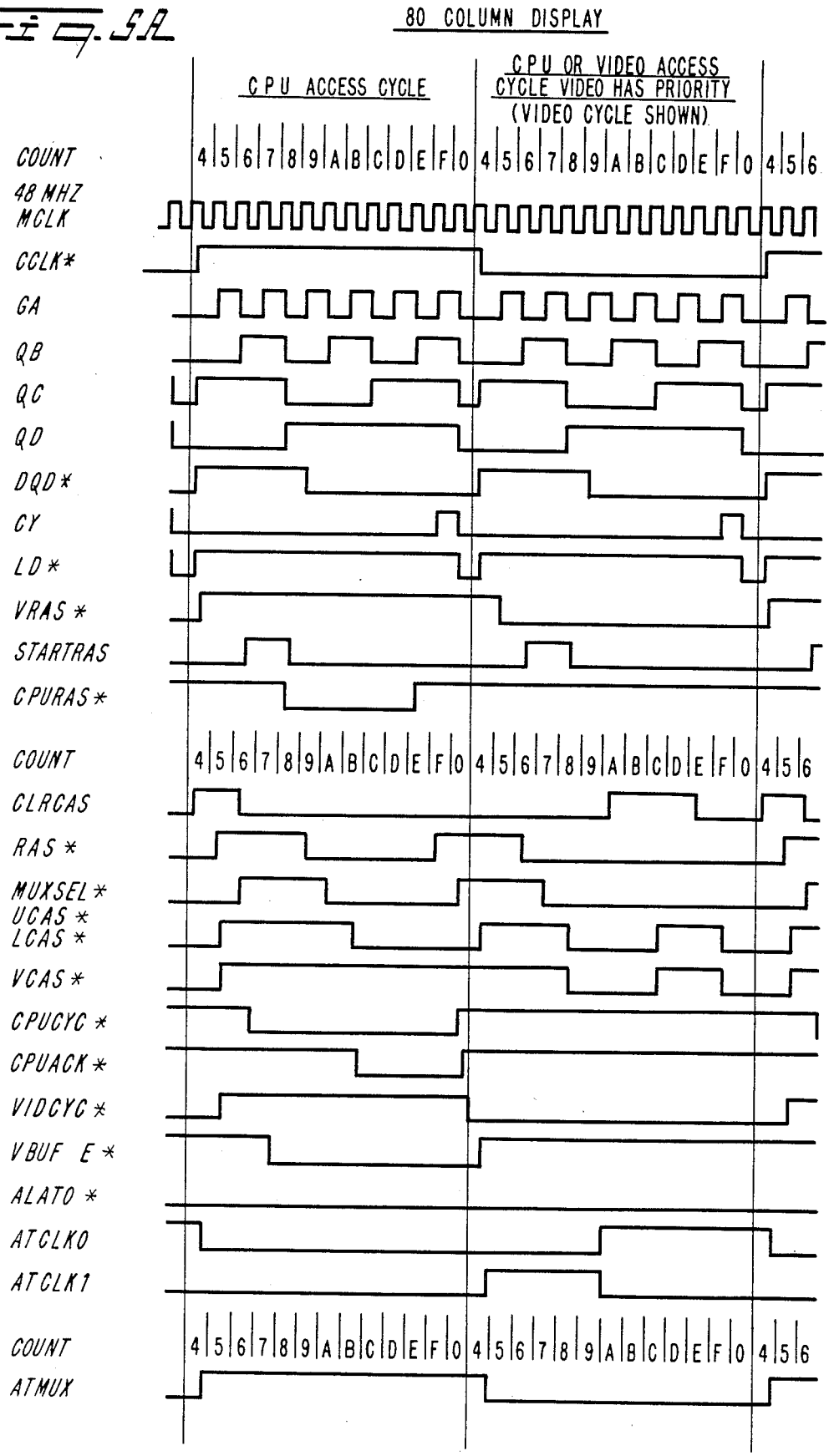
FIG. 5A illustrates memory cycle timing used in a first mode of operation or the circuits illustrated in FIGS. through 5.
Figure 5B:
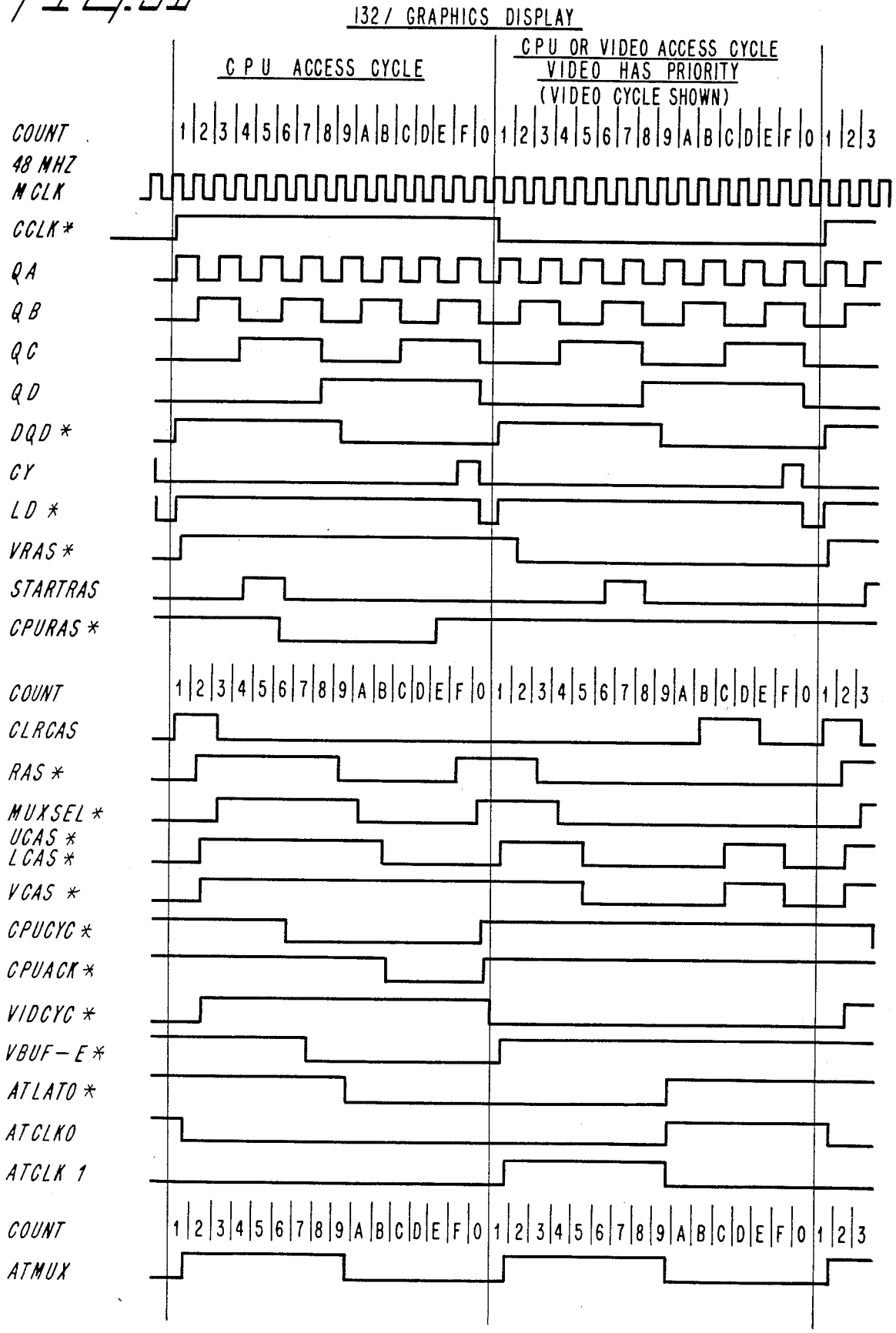
FIG. 5B illustrates memory cycle timing used in a second mode of operation of the circuits illustrated in FIGS. 2 through 4.

FIGS. 5A and 5B illustrate timing patterns for the circuits illustrated in FIGS. 2-4. FIG. 5A indicates the timing for the eighty column display whereas FIG. 5B illustrates the timing necessary to operate in the one hundred thirty-two column mode.

A standard character mapped terminal addresses its screen by maintaining a row/column address to the characters. All characters on any given lines are contiguous in memory. Because of this, as the cursor is moved across the screen, the address circulation for the next character to the right is simply an add by 1. In most graphics terminals, any given scan line will be stored in contiguous memory locations, but a single character vertically spans many scan lines. Accordingly, the information for a single character would not be stored in contiguous memory locations. Thus, writing each scan of every character requires an address calculation that depends on the resolution of the screen. In the present invention, a "zig-zag" addressing scheme was devised to speed the process of writing the characters to the display memory.

The "zig-zag" addressing scheme allows for all the bits in a character to be contiguous in display memory. Because of this, the processor writing the character may use its fastest mode of moving a block of data. In practice the processor uses an autoincrement addressing mode in a loop to copy the font image from firmware to the bit map memory. In addition, this address counter will automatically point to the next character to the right after the current character is done. In this way a single address counter may be used to write all the characters on a line with only a single address calculation.

This addressing scheme also simplifies the interface to a standard alphanumeric CRT controller. The CRT controller operates as if the display is character mapped with its scan line addresses used to control a character generator. In the present invention, the scan line addresses become the low order address to the bit map. However, the CRT controller is still able to manipulate the display with its row table for scrolling, and its scan line offset register for smooth rolling. In this way, the terminal maintains the scrolling ability of a character only terminal while adding full bit-mapped graphics.

Figures 6A, 6B, 6C:
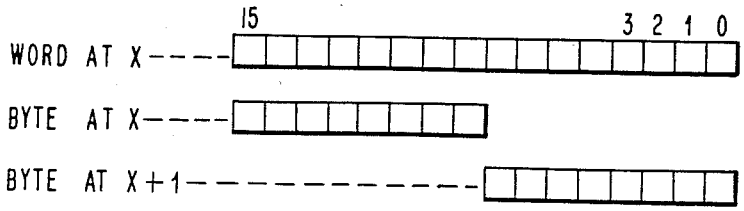
FIG. 6A illustrates bit map memory organization used with the first mode of operation of the circuits illustrated in FIGS. 2 through 4.
FIG. 6B illustrates bit map memory organization used with the second mode of operation of the circuits illustrated in FIGS. 2 through 4.
FIG. 6C illustrates the locations in memory of individual bits for a binary word.

The zig-zag memory configuration for the bit-map memory 14 for the eighty column mode is illustrated schematically in FIG. 6A. As discussed above, each character cell in the eighty column mode is made up of a 13×16 pixel matrix. Thus, the cell can be viewed as sixteen stacked "slices" of thirteen bits each. In a normal bit-mapped terminal, these slices of the character would not be in contiguous memory locations. With the zig-zag addressing scheme, however, the slices of the character are placed in adjacent memory locations, thus permitting the CPU 4 to operate in its fastest mode during write operations to the bit-map memory.

Referring to FIG. 6A, each slice of a character includes thirteen pixels. Each pixel of this group of thirteen pixels is represented by a single bit in the bit map. A digital word is made up of two bytes of information. Thus, each word in memory includes two bytes and has sixteen bits. Bits 15 to 3 of a digital word located at address A is used to map the thirteen pixels of the first slice of a first character (denoted chr0 in the Figure). Bits 2, 1 and 0 are not used. The word at address A includes a first byte at address A and a second byte at address A+1. The second slice of chr0 would be stored at memory locations A+2 and A+3.

A second character, chr1, is stored at word addresses A+32 through A+62. The bit-map for the third character, chr2, is stored in word addresses A+64 through A+94, etc. A second line of text begins at memory location B. The individual characters of the second line are addressed in the same manner as those in the first line.

Since each slice of the character requires two bytes of memory storage, each character requires thirty-two bytes of memory. Accordingly, each line of text requires 32*80=2,560 bytes of memory, and a twenty-five line display requires 25*2560=64,000 bytes of memory. If the eighty column mode is operated in an interlaced display mode, 128,000 bytes of memory would be required for each bit-map.

In the 132 column mode, each line of text includes 132 matrices of 8×16 pixels. Since each slice of the character requires only eight bits of the bit map, a single byte can be used to store each slice of a character. Thus, in the 132 column mode, the first slices of chr0 and chr1 are stored in bytes at memory locations A and A+1, respectively. The second slices of the first and second characters are stored at memory locations A+2 and A+3, respectively, and so on. The last slices of the first and second characters are stored in memory locations A+30 and A+31, respectively. The first slice of chr2 and chr3 are then stored at memory locations A+32 and A+33. A second line of text is mapped into the memory locations in the same manner as the first line beginning with memory address B.

Since each bit of the words in the bit-map memory is used in the 132 column mode, even less memory is required in the 132 column mode than in the 80 column mode. In the 132 column mode, each pixel array consists of an 8×16 matrix. Accordingly, the bit-map for each character requires 16 bytes of information. Thus, the total memory needed for the entire line of text is 16*132=2112 bytes of memory. A twenty-five line non-interlaced bit-map display would require 25*2112=52.8 Kbytes of memory. For the fifty lines of an interlaced display, the required bit-map memory would be 50*2112=105.6 Kbytes of memory.

FIG. 6C illustrates the location of individual bits for at word at a particular memory location. As illustrated, bits 15 to 8 of a word at memory location X are provided in the byte at memory location X. Bits 7 to 0 are located in the byte at memory location X+1. This follows the convention of the Motorola 68000 processor.

Figures 7, 8:
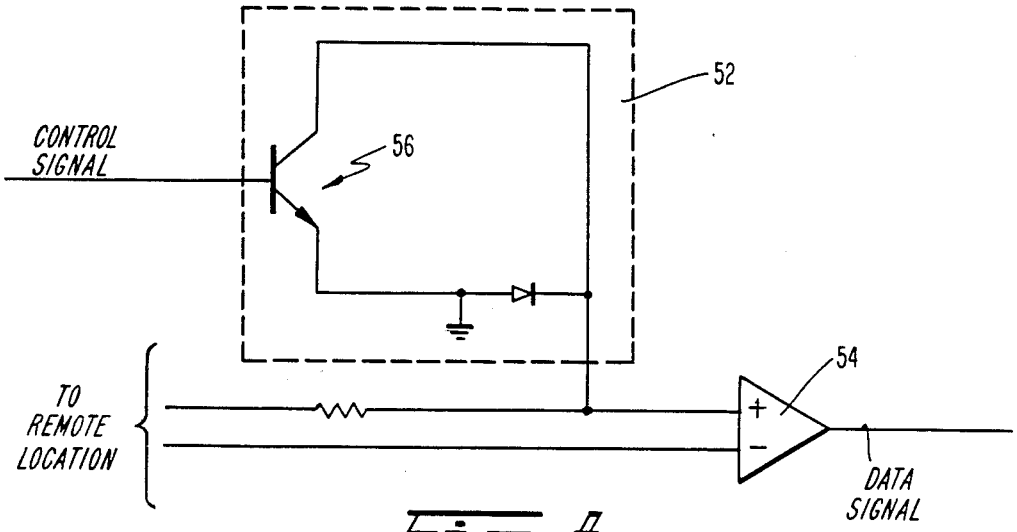
FIG. 7 schematically illustrates the relative position of stored character information and stored attribute information in system memory.
FIG. 8 schematically illustrates a receiver circuit for enabling receipt of either dual differential data transmission or single-ended data transmission.

FIG. 7 illustrates the relationship between the start address of a character in the bit-map memory and the corresponding location of the attribute information for the character in the attribute memory. The location of the attribute information is located at a fixed offset in memory from the start address of the character bit-map. For instance, the attribute information for chr0 in the 80 column mode is located in the upper 4 bits of the byte at memory location C00021 (all addresses are indicated in hexadecimal type code) and the bit-map for the character begins at memory location 800000. The lower four bits of the byte at location COO021 of the attribute memory store the attribute information for chr1. As discussed with reference to FIG. 2, the attribute latch includes a one-of-two selection circuit 42 for selecting the appropriate attribute information for the character being displayed.

The byte containing the attribute information for characters chr2 and chr3 may be located at attribute memory location CO0061. The bit-map for chr2 begins at bit-map memory location 800040. As is apparent, the offset between the starting address for the bit-map of chr0 and the corresponding attribute information is equal to the offset between the starting address of the bit-map of chr2 and its corresponding attribute information. This fixed offset greatly simplifies processing in the terminal.

FIG. 8 illustrates a circuit for enabling receipt of either dual differential data transmissions or single-ended transmissions. In single ended transmission, a differential amplifier has one input terminal tied to local ground whereas a second input terminal receives a data input from a remote location. Dual differential data transmission is often used where data is being transmitted over long distances. A twisted pair carries both inputs to the differential amplifier and the received video signal is determined by the difference between the signals on the twisted pair conductors.

A transmission selection circuit 52 is provided for enabling the differential amplifier 54 to receive dual differential data transmissions or single-ended data transmissions. For reception of single-ended data transmissions, a control signal is input to the selection circuit 52 to place transistor 56 in a conductive state to thereby effectively ground the non-inverting input to the amplifier 54. A remote data signal is then input to the inverting terminal of the amplifier 56.

For dual differential data transmission, the transistor 56 is turned OFF. A dual differential data signal may then be received at the input terminals of the amplifier 54. This ability to select the type of data transmission to be received offers a high degree of flexibility for the terminal.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A bit-mapped computer terminal comprising:
   - a display including a plurality of picture elements;
   - first memory means for storing a display bit map that defines characteristics of individual picture elements of said display;
   - second memory means for storing attribute information for individual groups of said picture elements of said display;
   - video control means for selectively lighting individual picture elements of said display in response to said bit map and said attribute information;
   - a serial communications port having a plurality of electrical contacts;
   - a receiver including a differential amplifier having a first input and a second input;
   - a first line coupling one of said electrical contacts with said first differential amplifier input; and
   - switch means for selectively grounding said second input, said switch means being open for reception of a dual differential data transmission and being closed for reception of a single-ended data transmission.

2. The computer terminal of claim 1, wherein said video control means includes means for scanning said display with a plurality of horizontal scan lines, said scanning means selectively operable in one of an interlaced mode and a non-interlaced mode.

3. The computer terminal of claim 2, wherein said scanning means is controlled by a keyboard input to select said interlaced mode or said non-interlaced mode.

4. The compute terminal of claim 2, wherein said scanning means is controlled by an input from a remote system to select said interlaced mode or said non-interlaced mode.

5. The computer terminal of claim 4, wherein said input from said remote system is a private coding sequence.

6. The bit-mapped computer terminal of claim 1, wherein a character to be displayed on said display is represented in contiguous memory locations in said first memory.

* * * * *